US005859625A

United States Patent [19]

Hartung et al.

[11] Patent Number: 5,859,625

[45] Date of Patent: Jan. 12, 1999

[54] DISPLAY DRIVER HAVING A LOW POWER MODE

[75] Inventors: Eytan Hartung, Boca Raton, Fla.; Fernando N. Hidalgo, Austin, Tex.

[73] Assignee: Motorola, Inc., Schaumburg, Ill.

[21] Appl. No.: 783,837

[22] Filed: Jan. 13, 1997

[51] Int. Cl.[6] ..... G09G 3/36

[52] U.S. Cl. ..... 345/95; 345/210

[58] Field of Search ..... 345/94–96, 208–210

[56] References Cited

U.S. PATENT DOCUMENTS

| | | | |
|---|---|---|---|
| 5,394,166 | 2/1995 | Shimada | 345/98 |
| 5,757,365 | 5/1998 | Ho | 345/212 |
| 5,805,121 | 9/1998 | Burgan et al. | 345/211 |

*Primary Examiner*—Jeffery Brier
*Attorney, Agent, or Firm*—James A. Lamb

[57] ABSTRACT

A display driver circuit (100) includes N scanning drivers (150) for driving a scanning set of display electrodes of a display panel (160) with a set of scanning signals (155), P information drivers (130) for driving an information set of display electrodes of the display panel (160) with a set of information signals (135), and a control section (120) having a first mode and a second mode. In the first mode the control section (120) controls the N scanning drivers (150) to generate N different scanning signals (155). In the second mode the control section controls the N scanning drivers (150) to generate a common scanning signal by S of the scanning drivers (156) and N–S different scanning signals by N–S drivers of the scanning drivers (157), wherein N, P and S are positive integers.

8 Claims, 6 Drawing Sheets

600

DISPLAY DRIVER HAVING A LOW POWER MODE

FIELD OF THE INVENTION

This invention relates in general to display driver circuits, and in particular to a display driver circuit for a display having a set of scanning electrodes and having at least two display modes, one of which is a low power mode in which a portion of the display remains active.

BACKGROUND OF THE INVENTION

Moderately complex liquid crystal displays capable of displaying graphics on a display panel that include either alphanumeric characters or icon segments, or both, are common place today in a variety of electronic devices. The graphics are formed from pixels. The information as to the state of each pixel is hereinafter referred to as the pixel information. Such liquid crystal displays typically have orthogonal electrodes on the front and back planes of the display panel, wherein the pixels are generated in one of two states at each crossing of the front and back electrodes. The back plane electrodes are typically driven with a set of scanning signals, each of which is a different periodic signal. The waveforms of the scanning signals are independent of the pixel information to be displayed. The front plane electrodes are typically driven with a set of information signals. The information signal of each front electrode is dependent on the pixel information to be displayed at the crossings of the front electrode and the back electrodes, and the waveform of each information signal is not necessarily different from the waveforms of other information signals. In particular, when the pixel information to be displayed on any two front plane electrodes is the same, the information signals for the two electrodes are the same.

In a battery operated electronic device such as a pager, it is highly desirable to achieve the smallest possible average power drain, because the average power drain determines the battery life of the pager. Typical pagers have a standby mode, which is a low power mode during which the user is not manipulating controls on the pager and during which the pager is awaiting a message from a paging system. The average power drain during the standby mode often dominates in the determination of the average power drain, and thus often dominates the determination of the battery life. When a battery operated electronic device incorporates such a moderately complex liquid crystal display, the power drain of the display can be a significant portion of the standby power drain.

Thus, what is needed is a technique to minimize the power drain of the liquid crystal display, in order to prolong the battery life of the portable electronic device.

DETAILED DESCRIPTION OF THE DRAWINGS

Figure 1:
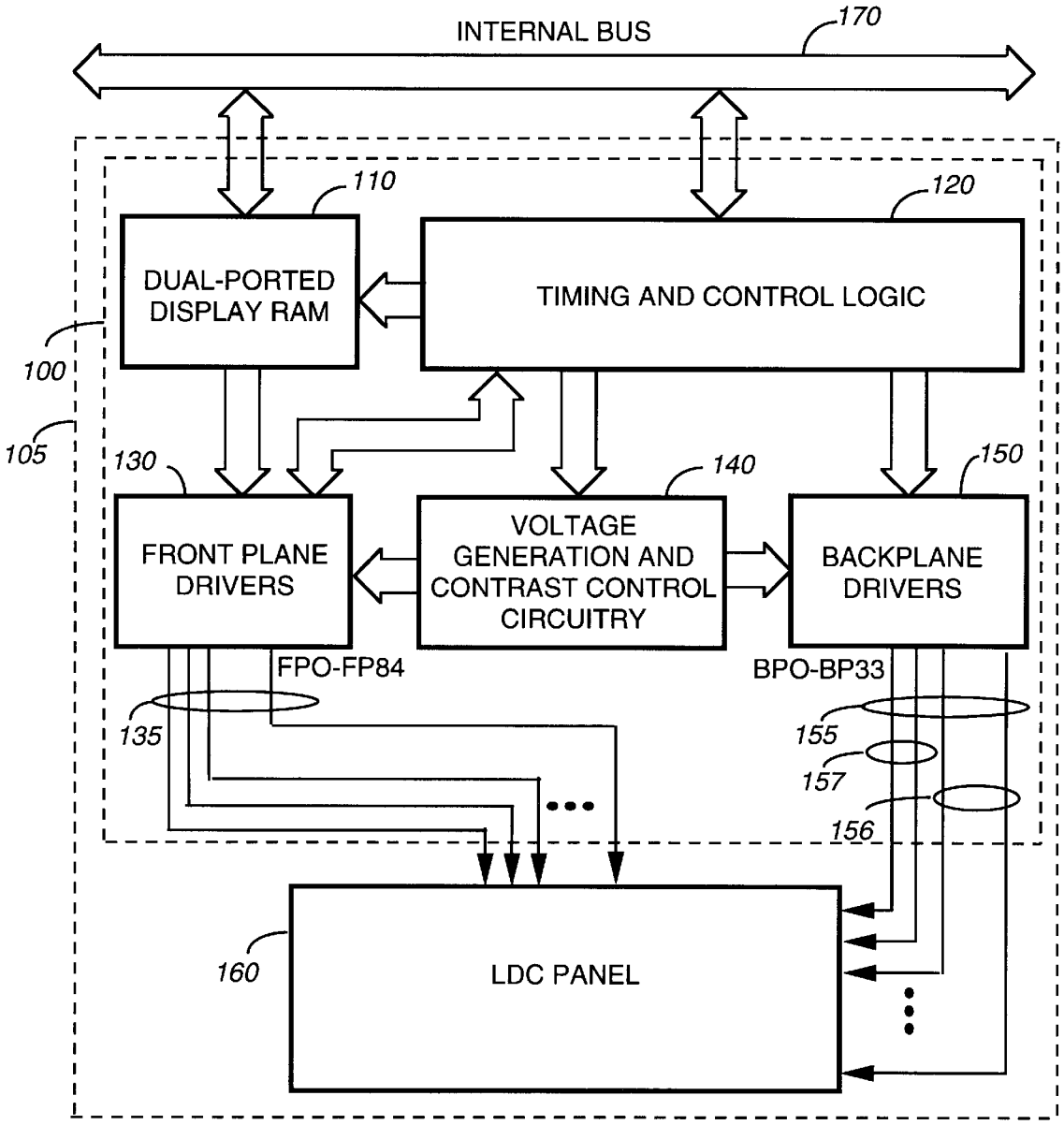
FIG. 1 is an electronic block diagram of a portion of an electronic device that includes a graphic display having a display panel and a display driver circuit, in accordance with the preferred embodiment of the present invention.

Referring to FIG. 1, an electronic block diagram of a portion of an electronic device that includes a graphics display 105 is shown, in accordance with the preferred embodiment of the present invention. The graphics display 105 comprises a display driver circuit 100 and a liquid crystal display (LCD) panel 160. The display driver circuit 100 comprises a dual-ported random access memory (RAM) 110, a timing and control logic section 120, frontplane drivers 130, voltage generation and contrast control circuitry 140, and backplane drivers 150. The dual ported RAM 110 and timing and control logic section 120 are coupled by an internal bus to a microprocessor (not shown in FIG. 1). The microprocessor organizes and stores graphic information that can be displayed on the LCD panel 160. The graphic information is encoded information which is a combination of alphanumeric (or ideographic) and icon information, such as ASCII (American Standard for Coded Information Interchange) encoded characters and binary encoded icon states. The processor converts the encoded information into pixel information, comprising bits organized into bytes, each bit representing a state of a pixel on the LCD panel 160, in a manner well known to one of ordinary skill in the art. In this invention, the pixel can be a dot within an alphanumeric/ideographic portion of the LCD panel 160, or an icon or an icon segment within an icon portion of the LCD panel 160. The pixel information is coupled to the dual ported RAM 110 of the display driver circuit 100 by an internal bus 170. The microprocessor also couples control information to the display driver circuit 100 to control conventional functions of the graphic display, such as contrast control and scrolling, as well as a unique function that selects one of two modes of the display, a normal mode and a standby mode. The standby mode is a low power mode. The control information is coupled in the form of bytes to the timing and control logic section 120 by the internal bus 170. The display driver circuit 100 is coupled to the LCD panel 160 by N outputs 155 of N backplane drivers 150, identified as BP0, BP1, . . . BPN and P outputs 135 of P frontplane drivers 130 identified as FP0, FP1, . . . FPP. In accordance with the preferred embodiment of the present invention, N is 34 and P is 85. The dual ported RAM 110 is coupled to the timing and control logic section 120 and the frontplane drivers 130. The dual ported RAM 110 accepts the pixel information in the form of bytes from the microprocessor, and couples the pixel information to the frontplane drivers 130 as determined by signals coupled from the control logic section 120.

The voltage generation and contrast control circuitry 140 generates a set of M voltage levels that are coupled to frontplane drivers 130 and backplane drivers 150. A minimum voltage level from which the set of M voltage levels are measured has a value $V_{ss}$, which can be any value, but in this example is assumed to be zero. Adjacent voltage levels are separated by a voltage $V_d$. Thus the maximum voltage level of the set of M voltage levels has a value of $V_{ss}+M\cdot V_d$. The voltage levels are generated by conventional circuitry including a charge pump circuit and voltage dividers. The voltage $M\cdot V_d$ is modified by a contrast adjustment signal generated in the voltage generation and contrast control circuitry 140 under control of the microprocessor, which responds to user inputs. The contrast adjustment signal varies the voltage $M\cdot V_d$(and also $V_d$) over a range of approximately 75% to 100% of a nominal value. In the normal mode more fully described below, the nominal value is 7.0 volts, so the range is from approximately 5.5 volts to 7.0 volts. The adjustment allows optimization of the "on" and "off" voltages (described below in more detail) to a threshold voltage range of a particular LCD panel 160, which varies among different LCD panels 160.

The timing and control logic section 120 is coupled to the frontplane drivers 130 for controlling generation of P information signals 135 by the P frontplane drivers 130, which are coupled to front plane electrodes of the LCD panel 160, and is further coupled to the backplane drivers 150 for controlling generation of N scanning signals 155 by the N backplane drivers 150, which are coupled to backplane electrodes of the LCD panel 160. The backplane drivers comprise N transistor output stages which generate N electrical signals 155, each of which is coupled to a backplane electrode of the display panel 160. The frontplane drivers comprise P transistor output stages which generate P electrical signals 135, each of which is coupled to a frontplane electrode of the display panel 160. The backplane and frontplane electrodes are fabricated on the front and back planes of the LCD panel 160 to be orthogonal to each other, and a dot, icon, or icon segment is activated or not activated at each crossing of the front and backplane electrodes, in a conventional manner, depending on the voltage between the front and back plane electrodes. In accordance with the preferred embodiment of the present invention, the icons or icon segments in the icon portion of the LCD panel 160 are associated with two backplane electrodes at the top of the LCD panel 160, while the remaining electrodes are associated with dots forming the alphanumeric/ideographic portion of the display. The timing and control logic section 120 controls the frontplane drivers 130 and the backplane drivers 150, which generate the scanning and information signals 155, 135 to have a voltage at any given time that is at one of the discrete voltage levels ranging between $V_{ss}$ and $V_{ss}+M\cdot V_d$. In accordance with the preferred embodiment of the present invention, $V_{ss}$ is 0 volts. The scanning signals 155 are periodic signals having a period of a frame. The period of the frame is set to one of several predetermined periods corresponding to frame rates within a range such as 30 frames per second to 141 frames per second (periods of 33.3 to 7.1 milliseconds, respectively), and is divided into two equal parts, named Field 1 and Field 2. The predetermined frame rate is hereafter identified as F. The Fields are further divided into equal time slots, during which a voltage of each scanning signal 155 remains at a voltage level. When the pixel information is static, the information signals 135 are also periodic signals having a period of a frame, and have the same number of time slots during which the voltage does not change. The voltage levels of the different time slots of the scanning signals 155 are independent of the pixel information, but the voltage levels of the different time slots of the information signals 135 are determined by the pixel information which is stored in the dual ported RAM 110.

Figure 2:
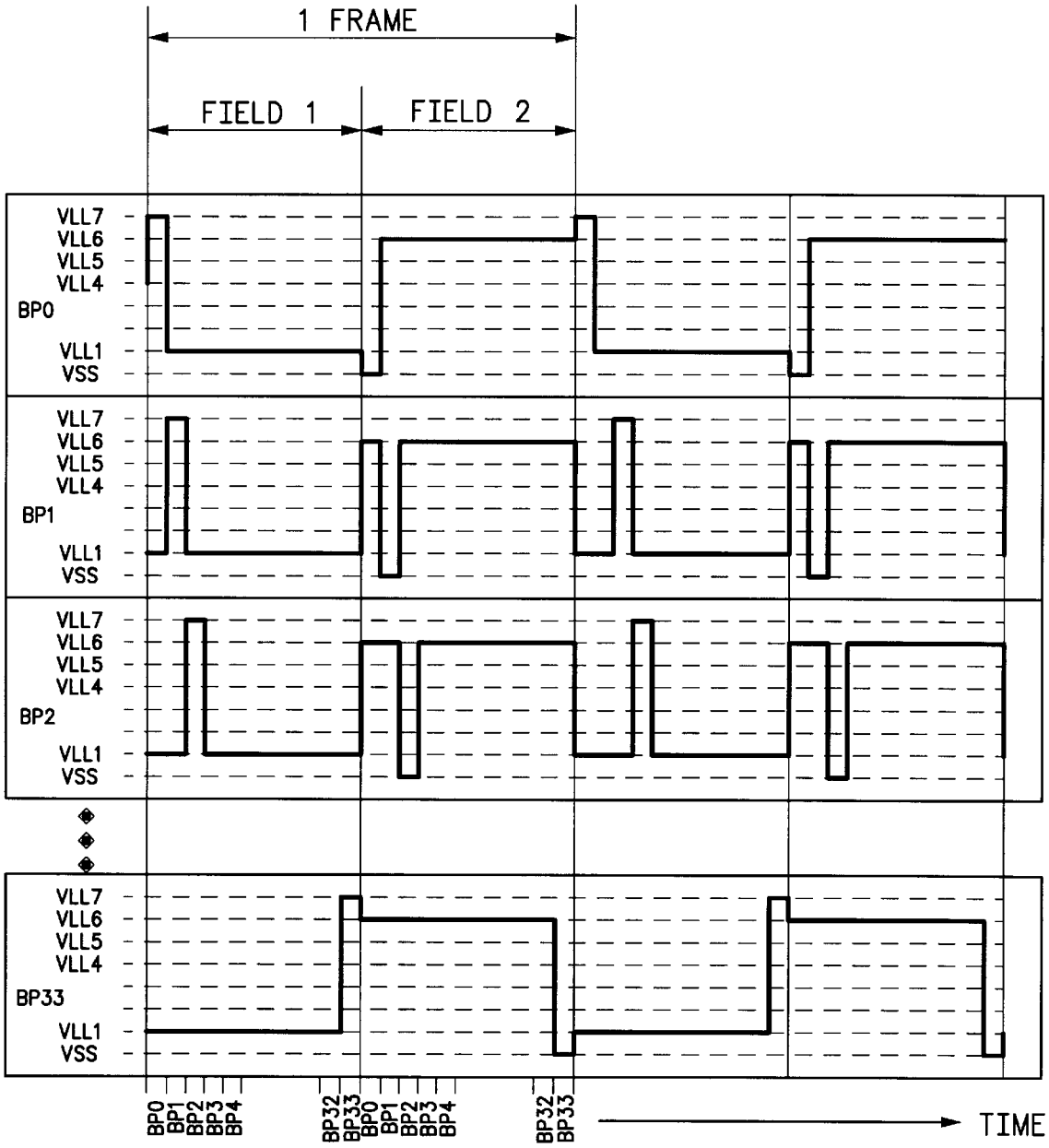
FIG. 2 illustrates scanning waveforms for several of the scanning signals generated by the backplane drivers of the display driver circuit during the normal mode when M=7 (7 voltage levels), in accordance with the preferred embodiment of the present invention.

Referring to FIG. 2, scanning waveforms for several of the scanning signals 155 generated by the backplane drivers 150 of the display driver circuit 100 during the normal mode when M=7 (7 voltage levels and a minimum voltage level) are illustrated, in accordance with the preferred embodiment of the present invention. The 34 backplane electrodes are named BP0, BP1, BP2, . . . BP33. The timing and control logic section 120 controls the frontplane drivers 130 and the backplane drivers 150 to generate the scanning and information signals 155, 135 so as to produce one of the set of voltage levels during each of 2·N time slots during a frame period. The voltage levels of the back and frontplane signals 155, 135 during a time slot are typically different. The display driver circuit 100 is unique in that it has two operating modes; the standby mode and the normal mode. In the normal mode, each scanning signal 155 is at $M\cdot V_d$ volts during one time slot of Field 1 and at zero volts ($V_{ss}$) during one time slot of Field 2 one half frame period thereafter. Each scanning signal 155 is at $V_d$ for the remaining time slots in Field 1. Each scanning signal 155 is at $(M-1)\cdot V_d$ for the remaining time slots of Field 2.

Figure 3:
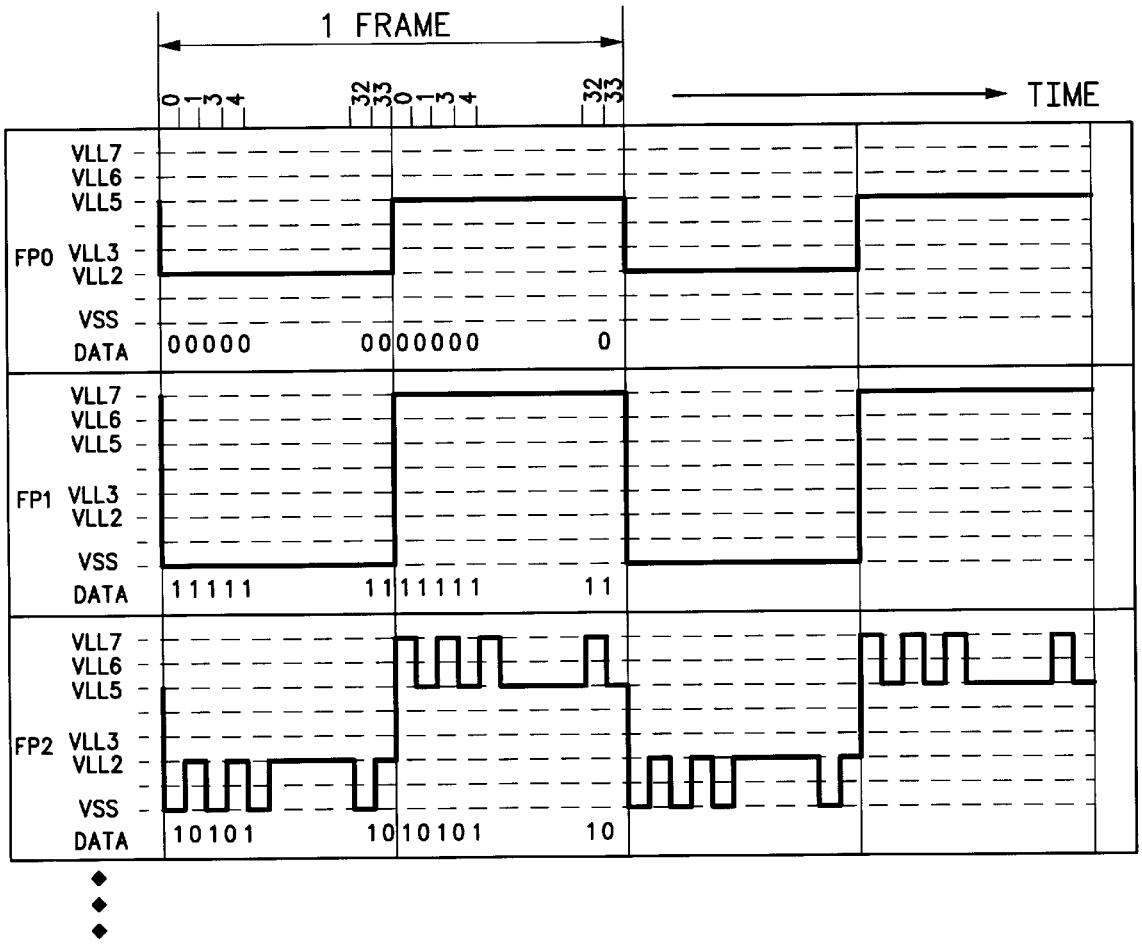
FIG. 3 illustrates examples of information waveforms generated by three frontplane drivers of the display driver circuit during the normal mode when N=34(34 backplane electrodes) and M=7 (7 voltage levels and a minimum voltage level), in accordance with the preferred embodiment of the present invention.

Referring to FIG. 3, examples of information waveforms generated by three frontplane drivers 130 of the display driver circuit 100 during the normal mode when N=34 (34 backplane electrodes) and M=7 (7 voltage levels and a minimum voltage level) are illustrated, in accordance with the preferred embodiment of the present invention.

Time slot numbers are shown at the top of the frame 1 portion of the chart. In the normal mode, each information signal 135 is at $V_{ss}$ during one time slot in Field 1 and is at $M\cdot V_d$ during one time slot in Field 2 one half frame period thereafter, for each pixel that is "on." Further, each information signal 135 is at $2\cdot V_d$ during one time slot in Field 1 and is at $(M-2)\cdot V_d$ during one time slot in Field 2 one half frame period thereafter, for each pixel that is "off." Three pixel information patterns are shown in FIG. 3 (all "off," or all 0's; all "on," or all 1's, and alternating 1's and 0's), corresponding to front plane driver outputs named FP0, FP1, and FP2.

For these signal waveforms, it is well known to one of ordinary skill in the art that the average voltage between the frontplane and backplane electrode at each crossing (i.e., at any pixel) is zero volts. Furthermore, the root mean square (rms) voltage at any pixel that is "off" and any pixel that is "on" is given by:

$$V_{rms}(\text{on}) = V_d\sqrt{\frac{M^2+N-1}{N}}\ . \qquad \text{Equation 1}$$

$$V_{rms}(\text{off}) = V_d\sqrt{\frac{(M-2)^2+N-1}{N}}\ . \qquad \text{Equation 2}$$

Further, it is well known to one of ordinary skill in the art that the ratio of $V_{rms}$(on) to $V_{rms}$(off) is mathematically maximized when:

$$M_{exact} = 1+\sqrt{N}\ . \qquad \text{Equation 3}$$

It will be appreciated that the relationship given by equation 3 results in a real number value that must be rounded to a nearest larger integer for practical use in an actual circuit, since the number of voltage levels must be an integer. Thus, the best value of M for achieving a maximizing value of the ratio of $V_{rms}$(on) to $V_{rms}$(off) is determined by rounding the value given by 1 plus the square root of N to the nearest larger integer. M is therefore substantially equivalent to, but not necessarily equal to, 1 plus the square root of N. Accordingly, when the number of scanning signals and electrodes is 34, then 1 plus the square root of N is approximately 6.83, so M=7 is the value which maximizes the ratio of $V_{rms}$(on) to $V_{rms}$(off) in this example circuit. Thus, there are 7 voltage levels above $V_{ss}$ for the situation shown in FIGS. 2 and 3. In accordance with the preferred embodiment of the present invention, the nominal value of $V_d$ is 1.00 volts, so the rms value of the "on" voltage is 1.5529 volts rms and the rms value of the "off" voltage is 1.3061 volts rms. It will be appreciated that, in accordance with the preferred embodiment of the present invention, the characteristics of the LCD panel 160 include a threshold voltage range over which a pixel changes between "off" and "on," which is the approximate range 1.40 to 1.45 volts for a display optimally responsive to the nominal voltage level $V_d$. Other display panels can have a lower threshold voltage range, which is accommodated, as described above with reference to FIG. 1, by adjusting the contrast signal which lowers the value of the voltages $V_d$ and $M \cdot V_d$, and thereby the "on" and "off" voltages.

During the standby mode, only the icons or icon segments are needed by the user of the electronic device. In order to minimize power, a method used in devices which have prior art LCD driver circuits is to set all the unneeded pixels in the alphanumeric/ideographic portion of the LCD panel 160 to "off," thereby establishing the rms voltage across all the unneeded pixels at the lower voltage (in this example, 1.3061 volts rms), thus reducing the power used. An alternative is to turn off the backplane electrodes entirely, but this leaves a residual net voltage across the unneeded pixels which arises from the information signals on the frontplane electrodes which are driving the on pixels, and can result in spurious "on" dots within the alphanumeric/ideographic portion of the LCD panel 160. Another problem that arises when the backplane electrodes are turned off is that DC voltages can cause the fluid to experience electrolysis, thereby damaging the LCD.

In accordance with the preferred embodiment of the present invention, in the standby mode the control logic 120 controls the backplane drivers to generate a common scanning signal at S outputs 156 of the N backplane drivers 150. The common scanning signal is coupled to the backplane electrodes for the alphanumeric/ideographic portion of the LCD panel 160 (hereafter, the "common electrodes). The control logic 120 further controls the backplane drivers to generate independent scanning signal at N−S outputs 157 of the N backplane drivers 150 for driving the icon portion of the display panel 160. The N−S scanning signals 157 are not only independent of each other, but also the common scanning signal 156 driving the common electrodes. Since the number of independent scanning signals is substantially reduced, the number of voltage levels can be reduced also. This has the effect of substantially reducing the power used for driving the "on" icon segments, as well as the "off" dots. In the example being described herein, 32 of the 34 electrodes are driven with the common scanning signal. Thus, N has been effectively reduced to 3, and the number of voltage levels is equal to 3 (the integer nearest to 1 plus the square root of 3). It will be appreciated that when the number of common electrodes is denoted by S (in this instance S=3), then the effective number of independent scanning signals in the standby mode, including the common scanning signal, is N−S+1. The rms value of the "on" voltage becomes 1.915 volts rms and the rms value of the "off" voltage becomes 1.00 volts rms. The scanning and information signals 155, 135 are generated in the normal and standby modes having the same frame rate, F. The scanning and information signals 155, 135 comprise time slots of duration $1/(2 \cdot F \cdot N)$ in the normal mode and $1/(2 \cdot F \cdot (N-S+1))$ in the standby mode.

In the example being described herein, there are 32×85, or 2720, dots, and 2×85, or 170 icon segments. In a typical standby mode, approximately half the icon segments are on. Therefore, in accordance with the preferred embodiment of the present invention in the typical standby mode, there are approximately 85 icon segments having 1.92 volts rms (the "on" voltage) applied when the nominal voltage, $V_d$, is 1.00 volts, approximately 85 icon segments having 1.00 volts rms (the "off" voltage) applied, and 2720 dots having 1.00 volts rms (the "off" voltage) applied. In prior art devices, there would be approximately 85 icon segments having 1.55 volts rms applied, approximately 85 icon segments having 1.31 volts rms applied, and 2720 dots having 1.31 volts rms applied. It will be appreciated that the amount of power consumed by the graphics display 105 is substantially reduced in comparison to prior art graphic displays because of the lower voltage applied across the large number of dots. It will be further appreciated that the amount of power consumed in the graphics display 105 is further reduced in comparison to prior art graphic displays because the voltage generation and contrast control circuitry 140 need generate only the voltage levels 1.0, 2.0, and 3.0 volts, allowing the stages which generate the higher voltages to be turned off in the standby mode.

Figure 4:
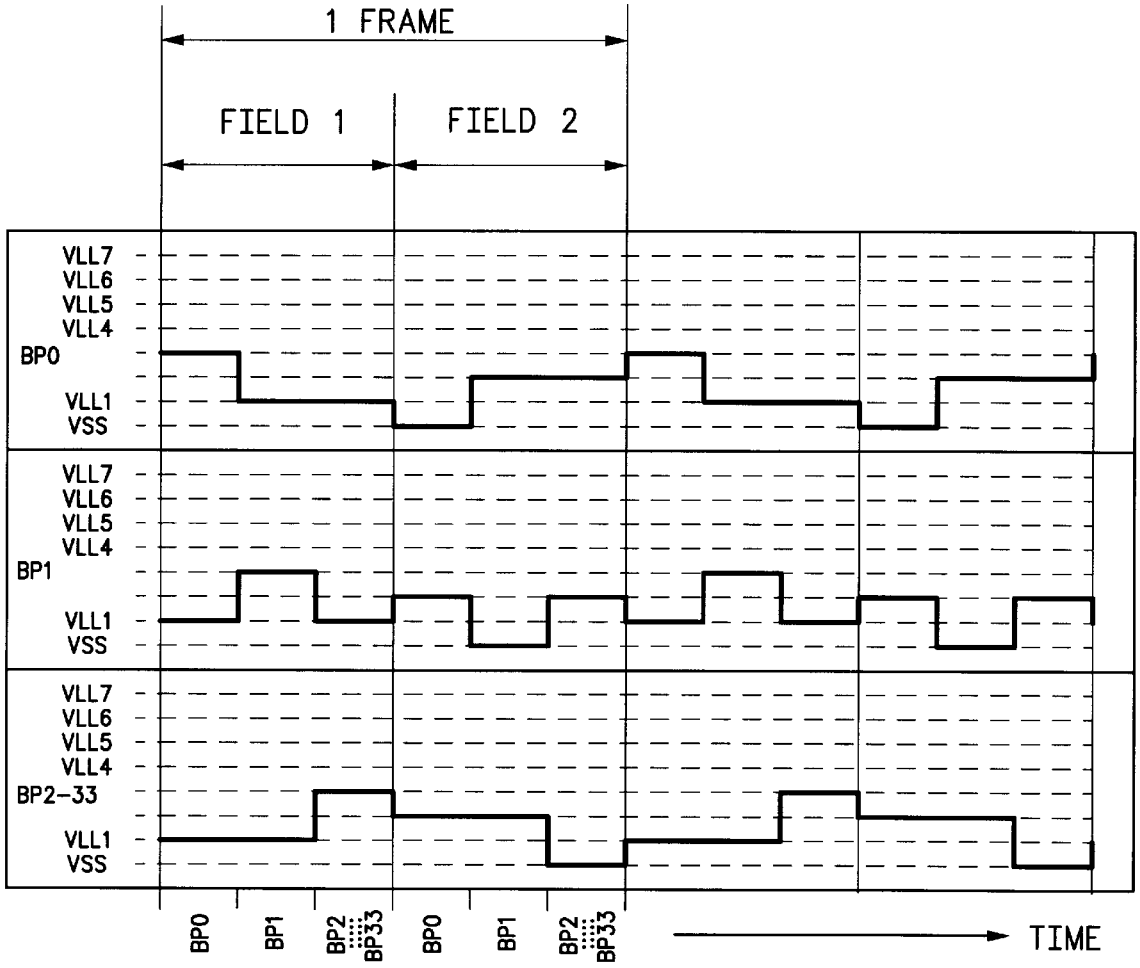
FIG. 4 illustrates waveforms for several of the scanning signals generated by the backplane drivers of the display driver circuit during the standby mode for the display driver circuit during the standby mode for the display driver circuit, when M=3 (3 voltage levels and a minumum voltage level), in accordance with the preferred embodiment of the present invention.

Referring to FIG. 4, waveforms for three independent scanning signals generated by the backplane drivers 150 of the display driver circuit 100 during the standby mode, when M=3 (3 voltage levels and a minimum voltage level) are illustrated, in accordance with the preferred embodiment of the present invention. The waveforms illustrated for scanning signals BP0 and BP1 are the independent waveforms of the scanning signals 156 for the icon portion of the display panel 160. The waveform illustrated for scanning signals BP2–BP33 is the common waveform of the scanning signals 157 for the alphanumeric/ideographic portion of the display panel 160.

Figure 5:
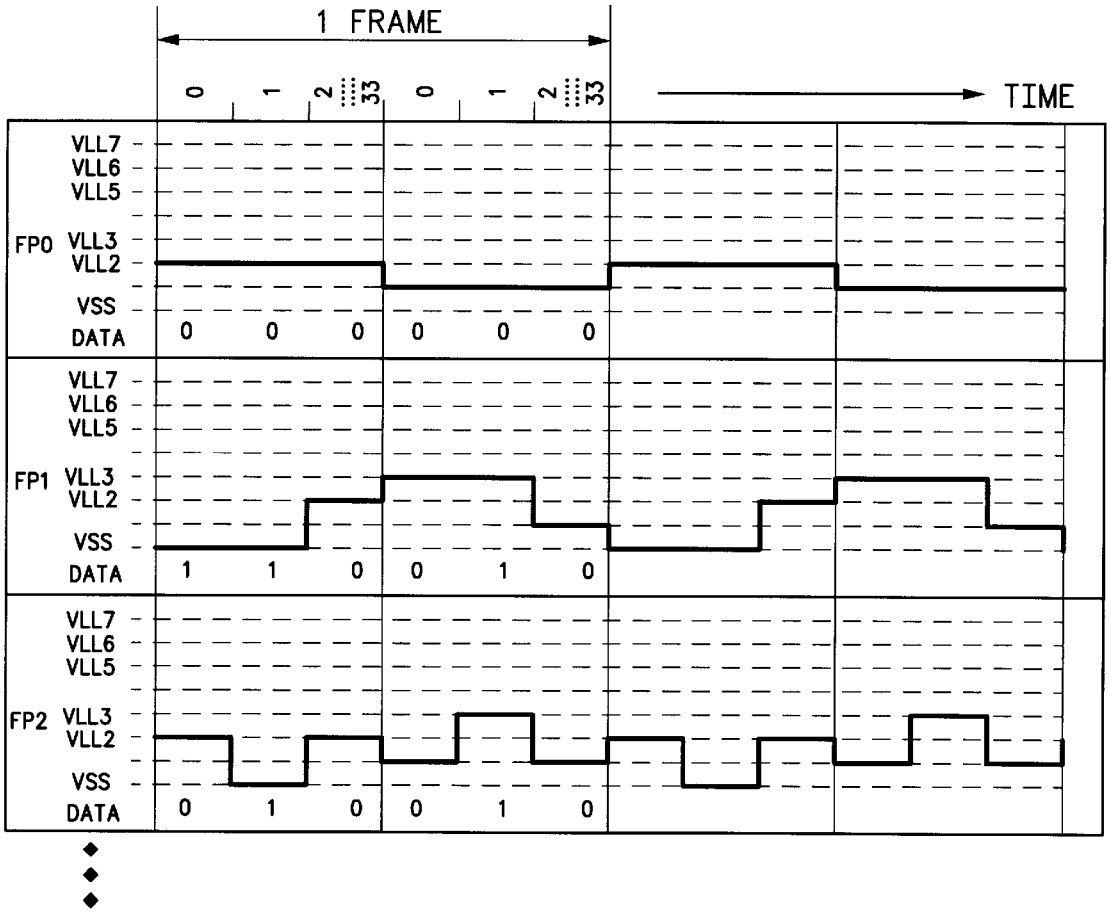
FIG. 5 illustrates examples of information waveforms generated by three frontplane drivers of the display driver circuit during the standby mode when N=34(34 backplane electrodes) and M=3 (3 voltage levels and a minimum voltage level), in accordance with the preferred embodiment of the present invention.

Referring to FIG. 5, examples of information waveforms generated by three frontplane drivers 130 of the display driver circuit 100 during the standby mode when N=34 (34 backplane electrodes) and M=3(3 voltage levels) are illustrated, in accordance with the preferred embodiment of the present invention. Waveforms of the information signals 135 FP0 FP1, and FP2 are shown. Information signal FP0 generates two "off" (0) icons (or icon segments) associated with the independently driven electrodes BP0 and BP1 during the first two time slots of each Field. Information signal 135 FP1 generates two "on" (1) icons (or icon segments) associated with the independently driven electrodes BP0 and BP1 during the first two time slots of each Field. Information signal FP2 generates an "off" (0) icon (or icon segment) associated with the independently driven electrode BP0 during the first time slot of each Field. Information signal FP2 generates an "on" (1) icon (or icon segment) associated with the independently driven electrode BP1 during the second time slot of each Field. The information signals 135 FP0, FP1, FP2 generate all "off" (0) dots associated with the commonly driven electrodes BP2, BP3, . . . BP33 of the alphanumeric/ideographic portion of the display panel 160 during the third time slot of each field.

It will be appreciated that the benefits of the present invention are obtained when $V_{ss}$ is a value other than zero volts; or when $V_d$ is a value other than 1.00 volts; or when the number of backplane electrodes is different than 34; or when the number of front plane electrodes is different than 85; or when the front and back plane electrode patterns are interchanged, and the scanning signals 155 are applied to front plane electrodes, and the information signals 135 are applied to back plane electrodes; or with various combinations of these variations. It will also be appreciated that the benefits of the present invention are obtained when the display panel has only dot pixels (no icons), and turns a portion of them off in the standby mode. It will be further appreciated that the benefits of the present invention are obtained when scanning signals 155 having waveforms other than those shown in FIGS. 2 and 4 are used for the scanning electrodes, if the waveforms have a characteristic that the rms voltage produced for an off state of a pixel is reduced when fewer independent scanning signals are used in the standby mode as compared to the standard power mode, and as long as the rms voltage of an on pixel is not increased so much that the power increase due to the raised voltage on the small number of "on" segments is larger than the power decrease due to the reduced voltage of the "off" dots and/or segments. It will be further appreciated that the present invention will provide power savings benefits in any other type of display which shares characteristics of the LCD display such as 1) a threshold voltage at which a pixel changes state between "off" and "on," 2) orthogonal electrodes used on a back and front plane, 3) a set of electrode signals which are scanning signals having a waveform independent of the pixel information, and 4) DC voltages must be avoided. It will be further appreciated that a graphics display can have multiple power saving modes, wherein each mode "deactivates" a different subset of the scanning electrodes which are otherwise independently scanned in the highest power (normal) mode. The deactivation is done, as described above with reference to FIGS. 2–5, by driving the deactivated electrodes with a common scanning signal.

A more generic description of the liquid crystal display driver circuit 100 in accordance with the present invention, which accommodates the above mentioned variations, is a display driver circuit which is capable of driving electrodes of a display panel to display information in the form of pixels, comprising N scanning drivers for driving a scanning set of display electrodes with a set of scanning signals, P information drivers for driving an information set of display electrodes with a set of information signals, and a control section coupled to the N scanning drivers and P information drivers. The control section has at least a first mode and a second mode. In the first mode the control section controls the scanning drivers to generate N different scanning signals by said N scanning drivers. In the second mode the control section controls the scanning drivers to generate a common scanning signal by S of the scanning drivers and N−S different scanning signals by N−S drivers of the scanning drivers, wherein N, P and S are positive integers. The N different scanning signals have M1 voltage levels in the first mode, and the common scanning signal and the N−S different scanning signals each have M2 voltage levels in the second mode. M1 and M2 are positive integers. There are substantially equivalent voltage differences between adjacent M1 voltage levels and between adjacent M2 voltage levels, and the number of M2 voltage levels is less than the number of M1 voltage levels. The number of M1 voltage levels is substantially $1+\sqrt{N}$ and the number of M2 voltage levels is substantially $1+\sqrt{N-S+1}$.

Figure 6:
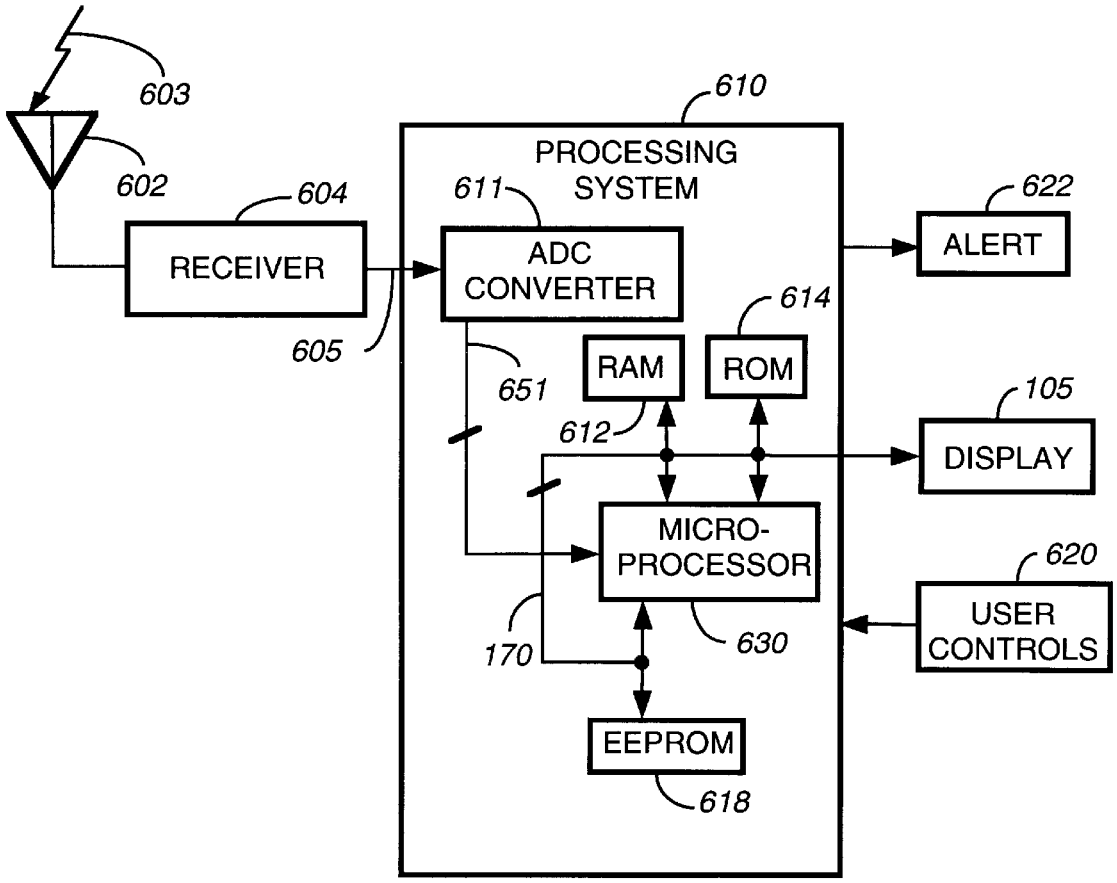
FIG. 6 is an electronic block diagram of a selective call radio, in accordance with the preferred embodiment of the present invention.

Referring to FIG. 6, an electrical block diagram of a selective call radio 600 is shown, in accordance with the preferred and alternative embodiments of the present invention. The selective call radio 600 includes an antenna 602 for intercepting an outbound radio signal. The antenna 602 is coupled to a conventional receiver 604 wherein the intercepted signal 603 is received. Receiving includes filtering to remove undesirable energy at off channel frequencies, amplification of the filtered signal, frequency conversion of the signal 603, and demodulation of the signal 603 in a conventional manner. The receiver 604 thereby generates a demodulated signal 605 that is coupled to a processing system 610. The processing system 610 is coupled to a graphics display 105, an alert 622, and a set of user controls 620. The processing system 610 comprises a microprocessor which is coupled to an analog to digital converter (ADC) 611, a random access memory (RAM) 612, a read only memory (ROM) 614, an electrically erasable programmable read only memory (EEPROM) 618, and the graphics display 105 by the internal processor bus 170. The demodulated signal 605 is coupled to the ADC 611, which converts the demodulated signal 605 from an analog signal to a digital signal in a conventional manner, for processing by the processing system 610. A bit recovery function converts the demodulated digital signal to binary data in a conventional manner. A message processor function decodes outbound words from the bits and processes an outbound message when an address received in the address field of the outbound signaling protocol matches an embedded address stored in the EEPROM 618, in a manner well known to one of ordinary skill in the art for a selective call radio 600. An outbound message that has been determined to be for the selective call radio 600 by the address matching is processed by the message processor function according to the contents of the outbound message and according to modes set by manipulation of the set of user controls 620, in a conventional manner. An alert signal is typically generated when an outbound message includes user information. The alert signal is coupled to the alert device 622, which is typically either an audible or a silent alerting component.

When the outbound message includes alphanumeric or graphic information, the information is displayed on the graphics display 105 in a conventional manner by a display function at a time determined by manipulation of the set of user controls 620. When the user selects a standby mode or when the user does not manipulate any controls for a predetermined duration, the processing system 610 changes the selective call radio 600 to the standby mode, in which the alphanumeric portion of the graphics display 105 is turned "off" and becomes blank. A row of icons remains active while the selective call radio 600 is in the standby mode. The icons show mode information, such as whether the alert is set for silent or audible operation, whether there are messages stored in the selective call radio 600, a low battery indication, etc.

The selective call radio 600 is similar to a Memo Express™ model radio, manufactured by Motorola, Inc. of Schaumburg, Ill. All portions of the selective call radio 600 are conventional, except for the graphics display 105 and the display control functions and pixel information generated by the processing system 610 and coupled to the graphics display 105. The display panel LCD panel 160 is designed using conventional techniques and technology, but the exact choice of icons and number of electrodes is unique. The display driver circuit 100 is constructed of conventional memory, logic, and analog circuits intercoupled in a unique fashion to provide the functions described herein with reference to FIGS. 1–6. The logic circuits are preferably of the random logic type, but the display driver circuit 100 may alternatively be based on a small controller such as a microprocessor in the family of 68HC11 microprocessors manufactured by Motorola, Inc., of Schaumburg, Ill., having a unique set of conventional program instructions stored therein to control the operation of the small controller which controls the generation of the information and scanning signals as described herein, for the low power and normal modes of the selective call radio 600. The display driver circuit 100 is preferably an integrated circuit.

It will be appreciated that the present invention will provide the power saving benefits described herein when used in electronic devices other than pagers, including portable electronic devices such as portable telephones and other personal communication devices.

By now it should be appreciated that there has been provided for an electronic device having a graphic display an LCD driver which uniquely drives a set of scanning electrodes of an LCD panel with one of at least two sets of scanning signals, depending on a mode of the electronic device, and that in one mode of the electronic device the set of scanning signals significantly reduces the power drain of the LCD driver and LCD panel combination compared to another mode.

We claim:

1. A display driver circuit capable of driving electrodes of a display panel to display information as pixels on the display panel, the display driver circuit comprising:

N scanning drivers for driving a scanning set of display electrodes of the display panel with a set of scanning signals;

P information drivers for driving an information set of display electrodes of the display panel with a set of information signals; and a control section coupled to said N scanning drivers and P information drivers, wherein said control section has a first and a second mode, and wherein in the first mode said control section controls the N scanning drivers to generate N different scanning signals, and wherein in the second mode said control section controls the N scanning drivers to generate a common scanning signal by S of said N scanning drivers and N–S different scanning signals, which are also different than the common scanning signal, by N–S drivers of the N scanning drivers, wherein N, P and S are positive integers, wherein the N different scanning signals have M1 voltage levels in the first mode, and the common scanning signal and the N–S different scanning signals each have M2 voltage levels in the second mode, and wherein M1 and M2 are positive integers.

2. The display driver circuit according to claim 1, wherein there is a substantially equivalent voltage difference between adjacent voltage levels of the M1 voltage levels and between adjacent voltage levels of the M2 voltage levels, and wherein M2 is less than M1.

3. The display driver circuit according to claim 1, wherein there is a substantially equivalent voltage difference between adjacent voltage levels of the M1 voltage levels and between adjacent voltage levels of the M2 voltage levels, and wherein M1 is an integer substantially equal to $1+\sqrt{N}$ and M2 is an integer substantially equal to $1+\sqrt{N-S+1}$.

4. A display driver circuit capable of driving electrodes of a display panel to display information as pixels on the display panel, the display driver circuit comprising:

N scanning drivers for driving a scanning set of display electrodes of the display panels with a set of scanning signals;

P information drivers for driving an information set of display electrodes of the display panel with a set of information signals; and a control section coupled to said N scanning drivers and P information drivers, wherein said control section has a first and a second mode, and wherein in the first mode said control section controls the N scanning drivers to generate N different scanning signals, and wherein in the second mode said control section controls the N scanning drivers to generate a common scanning signal by S of said N scanning drivers and N–S different scanning signals, which are also different than the common scanning signal, by N–S drivers of the N scanning drivers, wherein N, P and S are positive integers, wherein the scanning and information signals are generated having a frame rate of F per second in the first and second modes, and wherein the scanning and pixel signals comprise time slots of duration $1/(2\cdot F\cdot N)$ seconds in the first mode and $1/(2\cdot F\cdot(N-S+1))$ seconds in the second mode.

5. A selective call radio, comprising:

a receiver for receiving a radio signal including information;

a processing section, coupled to said receiver, which decodes the information and generates a set of information signals therefrom;

a liquid crystal display (LCD) panel for displaying the information; and an LCD driver circuit, coupled to said processing section and said LCD panel, capable of driving electrodes of said LCD panel to display the information as pixels, comprising N scanning drivers for driving a scanning set of display electrodes of the LCD panel with a set of scanning signals;

P information drivers for driving an information set of display electrodes of the LCD panel with a set of information signals; and a control section coupled to said N scanning drivers and P information drivers, wherein said control section has a first and a second mode, and wherein in the first mode said control section controls the N scanning drivers to generate N different scanning signals, and wherein in the second mode said control section controls the N scanning drivers to generate a common scanning signal by S of said N scanning drivers and N–S different scanning signals by N–S drivers of the N scanning drivers, wherein N, P and S are positive integers, and wherein the N different scanning signals have M1 voltage levels the first mode, and the common scanning signal and the N–S different scanning signals each have M2 voltage levels in the second mode, and wherein M1 and M2 are positive integers.

6. The selective call radio according to claim 5, wherein there is a substantially equivalent voltage difference between adjacent voltage levels of the M1 voltage levels and between adjacent voltage levels of the M2 voltage levels, and M2 is less than M1.

7. The selective call radio according to claim 5, wherein there is a substantially equivalent voltage difference between adjacent voltage levels of the M1 voltage levels and between adjacent voltage levels of the M2 voltage levels, and wherein M1 is an integer substantially equal to $1+\sqrt{N}$ and M2 is an integer substantially equal to $1+\sqrt{N-S+1}$.

8. A selective call radio, comprising:

a receiver for receiving a radio signal including information;

a processing section, coupled to said receiver, which decodes the information and generates a set of information signals therefrom;

a liquid crystal display (LCD) panel for displaying the information; and an LCD driver circuit, coupled to said processing section and said LCD panel, capable of driving electrodes of said LCD panel to display the information as pixels, comprising N scanning drivers for driving a scanning set of display electrodes of the LCD panel with a set of scanning signals;

P information drivers for driving an information set of display electrodes of the LCD panel with a set of information signals; and a control section coupled to said N scanning drivers and P information drivers, wherein said control section has a first and a second mode, and wherein in the first mode said control section controls the N scanning drivers to generate N different scanning signals, and wherein in the second mode said control section controls the N scanning drivers to generate a common scanning signal by S of said N scanning drivers and N−S different scanning signals by N−S drivers of the N scanning drivers, wherein N, P and S are positive integers; and wherein the scanning and information signals are generated having a frame rate if F per second in the first and second modes, and wherein the scanning and pixel signals comprise time slots of duration $1/(2\cdot F\cdot N)$ seconds in the first mode and $1/(2\cdot F\cdot(N-S+1))$ seconds in the second mode.

* * * * *